US009751125B2

(12) United States Patent
Ozeki et al.

(10) Patent No.: US 9,751,125 B2
(45) Date of Patent: Sep. 5, 2017

(54) METHOD OF MANUFACTURING A GEAR

(71) Applicant: HONDA MOTOR CO., LTD., Tokyo (JP)

(72) Inventors: Takeshi Ozeki, Mooka (JP); Shoji Namiki, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 262 days.

(21) Appl. No.: 14/524,029

(22) Filed: Oct. 27, 2014

(65) Prior Publication Data

US 2015/0128419 A1 May 14, 2015

(30) Foreign Application Priority Data

Nov. 8, 2013 (JP) ..... 2013-231682

(51) Int. Cl.
*B21K 1/30* (2006.01)
*B21J 13/02* (2006.01)
*B21J 5/02* (2006.01)

(52) U.S. Cl.
CPC ..... *B21K 1/30* (2013.01); *B21J 5/022* (2013.01); *B21J 13/02* (2013.01); *Y10T 29/49474* (2015.01)

(58) Field of Classification Search
CPC ..... B21K 1/30; B21J 9/02; B21J 5/022; B21J 13/02; Y10T 29/49474; Y10T 29/49476; Y10T 29/49462; Y10T 29/49467
See application file for complete search history.

(56) References Cited

U.S. PATENT DOCUMENTS 5,815,922 A * 10/1998 Sato ..... B21K 1/30 29/893.34
8,024,952 B2 * 9/2011 Hossler ..... B21J 9/022 72/354.8
2009/0090007 A1 * 4/2009 Takada ..... B21D 28/16 29/893.1
2012/0216644 A1 * 8/2012 Sakamaki ..... B21K 1/30 74/434

FOREIGN PATENT DOCUMENTS

JP 3769856 B2 4/2006

* cited by examiner

*Primary Examiner* — Sarang Afzali
(74) *Attorney, Agent, or Firm* — Squire Patton Boggs (US) LLP

(57) ABSTRACT

A forging apparatus carries out a method of manufacturing a gear having external teeth on an outer circumferential wall surface thereof and internal teeth on an inner circumferential wall surface thereof. First, an internal tooth forming die is inserted through a through hole defined in a workpiece. Next, a pressing die is caused to abut against the workpiece, and an external tooth machining die finishes the external teeth while preventing a support die from being lowered under action of damping mechanisms. Thereafter, a pressing die presses the workpiece to apply a load in excess of a preset load for the damping mechanisms. The support die is then lowered to lower the workpiece along the internal tooth forming die. At this time, the internal teeth are formed on the inner circumferential wall surface of the workpiece.

4 Claims, 8 Drawing Sheets

METHOD OF MANUFACTURING A GEAR

CROSS-REFERENCE TO RELATED APPLICATION

This application is based upon and claims the benefit of priority from Japanese Patent Application No. 2013-231682 filed on Nov. 8, 2013, the contents of which are incorporated herein by reference.

BACKGROUND OF THE INVENTION

Field of the Invention

The present invention relates to a method of manufacturing a gear having a plurality of external teeth on an outer circumferential wall surface thereof and a plurality of internal teeth on an inner circumferential wall surface thereof, and a forging apparatus for manufacturing such a gear.

Description of the Related Art

Gears that have external teeth on an outer circumferential wall thereof and internal teeth on an inner circumferential wall thereof are used in some applications. In this case, for example, the internal teeth are held in mesh with teeth on a circumferential side wall of a shaft member, thereby coupling the gear to the shaft member. Therefore, a process of welding the gear to the shaft member is not necessary.

When this type of gear is manufactured, the external teeth and the internal teeth may be formed by different forging apparatus, respectively. Alternatively, the external teeth and the internal teeth may be formed by one forging apparatus, as disclosed in Japanese Patent No. 3769856. Specifically, the forging apparatus disclosed in Japanese Patent No. 3769856 has a mandrel serving as an internal tooth forming die for forming internal teeth and a die serving as an external tooth forming die for forming external teeth.

With the forging apparatus thus constructed, a gear is manufactured as follows. First, after the mandrel is passed through a through hole in a workpiece, an upper die is lowered while the workpiece is being sandwiched by a knockout pin and an outer punch. As a result, the material of the workpiece flows into grooves between internal tooth forming teeth of the mandrel, whereby internal teeth are preformed on an inner circumferential wall of the workpiece.

Then, the upper die and the knockout pin are further lowered. The workpiece is pressed by the outer punch and pushed out downwardly. At this time, external tooth forming teeth on an inner circumferential wall of the die extrudes external teeth (spur gear teeth) on an outer circumferential wall of the workpiece. Since the material of the workpiece also flows radially inwardly, the preformed internal teeth are formed into helical splines as a final tooth form, whereupon the desired gear is produced.

SUMMARY OF THE INVENTION

As described above, the external teeth and the internal teeth are simultaneously formed according to the technology disclosed in Japanese Patent No. 3769856. However, it is not easy for the disclosed forging process to control the flow of the workpiece material, and hence it is not easy to mass-produce gears of good dimensional accuracy.

It is a major object of the present invention to provide a method of manufacturing a gear, which is capable of individually performing a machining process for forming external teeth and a machining process for forming internal teeth during one-time closing of a die assembly.

Another object of the present invention is to provide a method of manufacturing a gear, which is easy to obtain a gear of good dimensional accuracy.

Still another object of the present invention is to provide a forging apparatus for manufacturing a gear described above.

According to an aspect of the present invention, there is provided a method of manufacturing a gear having external teeth on an outer circumferential wall surface thereof and internal teeth on an inner circumferential wall surface thereof, including the steps of:

bringing a pressing die and an external tooth machining die toward a workpiece having a through hole, with an internal tooth forming die being inserted in the through hole, is the workpiece being supported from below by a support die, and causing the pressing die to abut against the workpiece;

forming the external teeth on the outer circumferential wall surface of the workpiece by lowering the external tooth machining die while preventing the support die from being lowered under action of damping mechanisms that support the support die from below; and after the external tooth machining die abuts against the support die, pressing the support die to cause some or all of the damping mechanisms to descend, and pressing the workpiece with the pressing die to lower the workpiece along the internal tooth forming die for thereby forming the internal teeth on the inner circumferential wall surface of the workpiece.

According to another aspect of the present invention, there is also provided a forging apparatus for manufacturing a gear having external teeth on an outer circumferential wall surface thereof and internal teeth on an inner circumferential wall surface thereof, including:

an internal tooth forming die configured to be inserted through a through hole defined in a workpiece in order to form the internal teeth;

a support die supporting from below the workpiece with the internal tooth forming die being inserted through the through hole;

damping mechanisms supporting the support die from below and which is configured to start to lower the workpiece when a load in excess of a preset load is applied to the damping mechanisms;

a pressing die configured to lower the workpiece along the internal tooth forming die; and an external tooth machining die configured to form the external teeth on the outer circumferential wall surface of the workpiece;

wherein the pressing die abuts against the workpiece before the external tooth machining die abuts against the support die; and after the external tooth machining die abuts against the support die, the external tooth machining die presses the support die to cause some or all of the damping mechanisms to descend, and the workpiece is pressed by the pressing die and thereby lowered along the internal tooth forming die.

Since the damping mechanisms are employed in the present invention, the external teeth are machined and the internal teeth are formed at different times. Therefore, it is easy to control the flow of the material of the workpiece.

Thus, the workpiece is lowered along the internal tooth forming die while being restrained by the pressing die and the external tooth machining die. At this time the internal teeth are formed, and thus the forming accuracy is enhanced. Therefore, the gear (forged product) can be manufactured with excellent dimensional accuracy.

Both the machining of the external teeth and the forming of the internal teeth are performed during one-time closing of a die assembly of the forging apparatus. Consequently, the cycle time of the forging apparatus can be shortened.

As described above, by using the above structure and performing the above processes, gears that are of excellent dimensional accuracy can be successively manufactured within a short period of time. The present invention is thus suitable for use as a mass-production facility.

Preferably, there may be further provided a surrounding member surrounding the support die and having first engaging members, and the external tooth machining die may have second engaging members. The first engaging members and the second engaging members may be caused to engage with each other when the external tooth machining die is lowered.

By the above engagement, the external tooth machining die is prevented from rotating about its own axis, i.e., from being brought out of phase with respect to the internal tooth forming die. The coaxiality between the internal teeth and the external teeth can be enhanced.

Preferably, the damping mechanisms may include gas springs having respective rods, and the rods are lowered when the external tooth machining die presses the support die.

If the damping mechanisms include a back-pressure regulating device which employs a working oil, then it is necessary to supply and discharge the working oil in order to operate the back-pressure regulating device at the time a load in excess of a preset load is applied to the back-pressure regulating device. Consequently, the back-pressure regulating device needs to be combined with an oil reservoir and mechanisms such as a supply pump, etc. However, if the damping mechanisms include gas springs, then the forging apparatus can be of a small-scale, simple structure, and hence can be effective to reduce investments for facilities required to manufacture the gear. Furthermore, it is not necessary to supply and discharge a working oil.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A method of manufacturing a gear according to a preferred embodiment of the present invention in relation to a forging apparatus for carrying out the method will be described in detail below with reference to the accompanying drawings.

Figure 1:
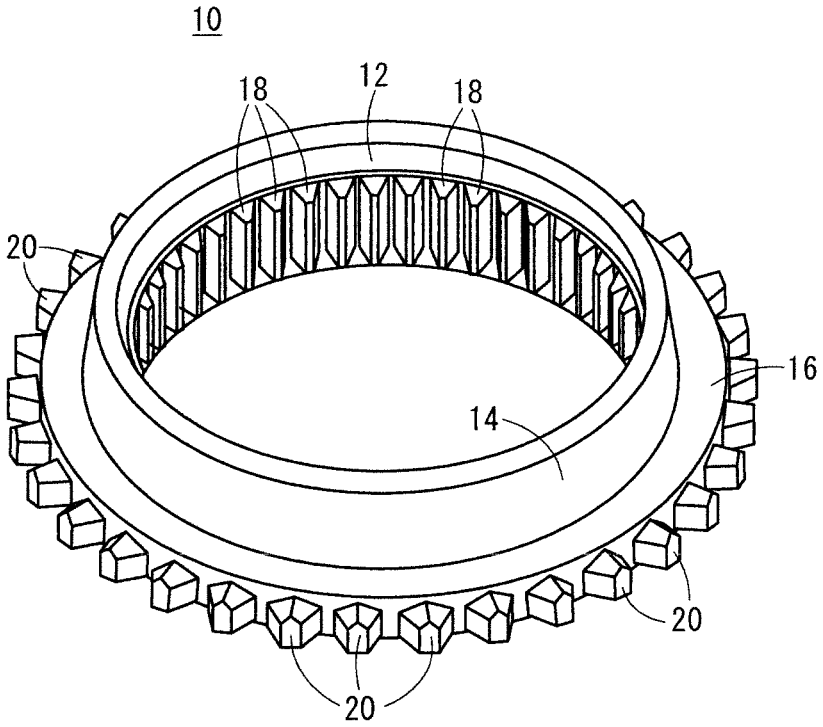
FIG. 1 is an overall schematic perspective view of a gear as a forged product.

A gear as a forged product will be described below with reference to FIG. 1. As shown in FIG. 1, a gear 10 has a short hollow cylinder 14 with a through hole 12 defined therein and a flange 16 projecting radially outwardly from an end portion of the hollow cylinder 14. The hollow cylinder 14 has a plurality of splines 18 disposed on an inner circumferential wall surface thereof. The splines 18 each extend straight along a heightwise direction (axial direction) of the hollow cylinder 14.

The flange 16 has a plurality of so-called dog teeth 20 disposed on an outer circumferential wall surface thereof. The gear 10 is thus in the form of a hollow body with the splines 18 formed as internal teeth and the dog teeth 20 as external teeth. The splines 18 are longer than the dog teeth 20.

Figure 2:
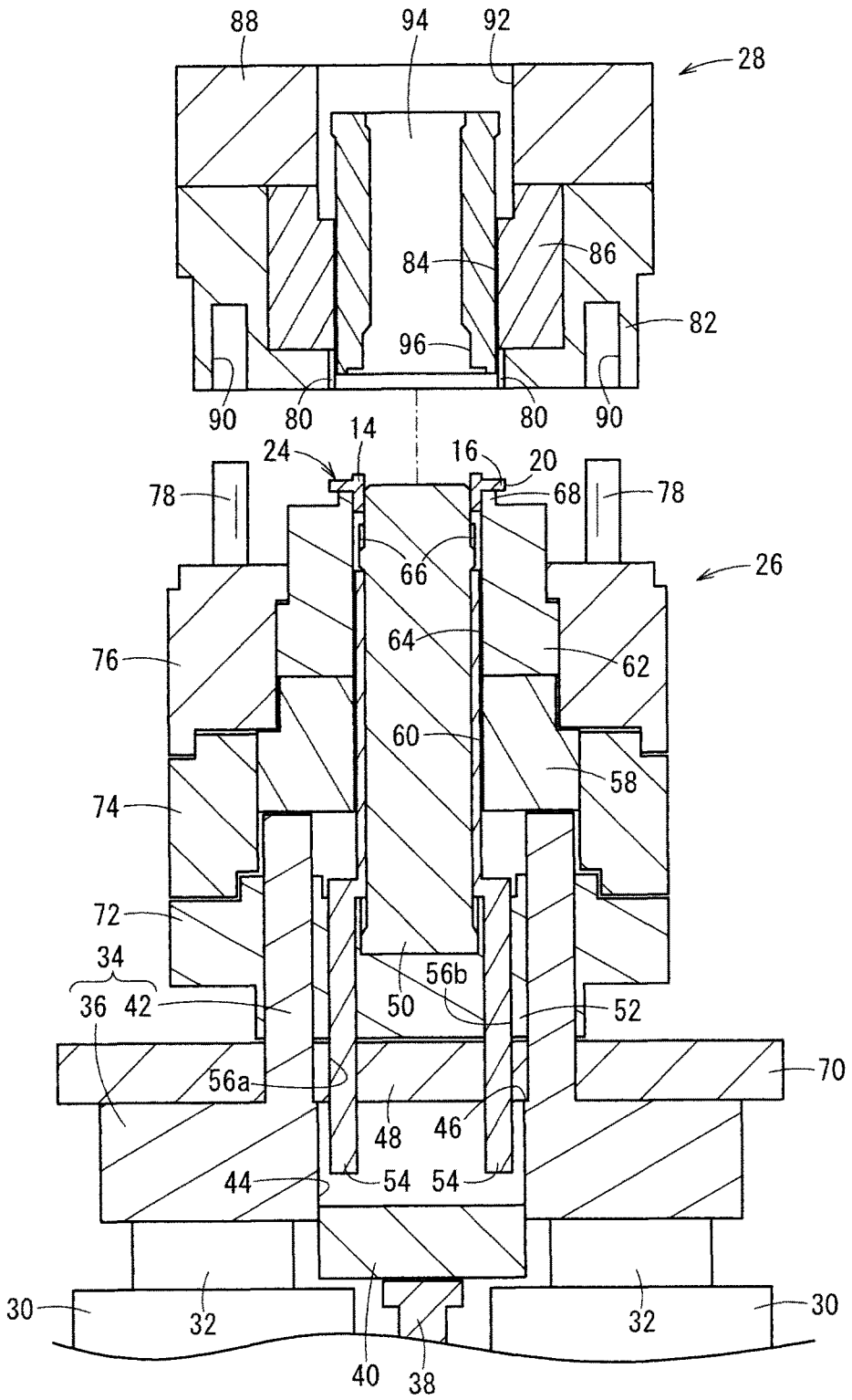
FIG. 2 is a fragmentary schematic vertical cross-sectional view of a forging apparatus according to an embodiment of the present invention.

As shown in FIG. 2, a forging apparatus 22 according to the present embodiment uses, as a workpiece 24, a preformed product having dog teeth 20 formed on an outer circumferential wall surface of a flange 16, finishes the dog teeth 20, and then forms splines 18 on an inner circumferential wall surface of the workpiece 24, thereby producing the gear 10 (see FIG. 1). The forging apparatus 22 will be described below.

FIG. 2 is a fragmentary schematic vertical cross-sectional view of the forging apparatus 22 according to the present embodiment. The forging apparatus 22 has a die assembly including a lower die 26 and an upper die 28.

The lower die 26 includes a plurality of gas springs 30 (damping mechanisms) arranged in a circular array. Each of the gas springs 30 has a damping rod 32. The damping rod 32 is kept in an initial position until a load applied to the damping rod 32 reaches a preset load, and is retracted (lowered) when the applied load exceeds the preset load.

A first sleeve 34 that is essentially in the form of a hollow cylinder has a large-diameter portion 36 coupled to the damping rods 32 of the gas springs 30. An extrusion cylinder, not shown, has an extrusion rod 38 disposed between the gas springs 30. A substantially disk-shaped extrusion plate 40 is coupled to the distal end of the extrusion rod 38. When the extrusion rod 38 is pushed forward (lifted), the extrusion plate 40 enters an insertion hole 44 that is defined in the large-diameter portion 36 and a tubular portion 42 of the first sleeve 34.

The first sleeve 34 has an annular step 46 disposed on an inner wall surface of the insertion hole 44. The annular step 46 supports thereon a substantially disk-shaped first support plate 48 on which there is disposed a second support plate 52 that support thereon a spline punch serving as an internal tooth forming die. The first support plate 48 and the second support plate 52 are housed in the insertion hole 44.

The first support plate 48 and the second support plate 52 support knockout pins 54 for releasing the gear 10 produced from the workpiece 24 off the spline punch 50. The knockout pins 54 have lower portions which are inserted in support holes 56*a*, 56*b* that are defined respectively in the first support plate 48 and the second support plate 52.

The knockout pins 54 have respective upper portions slidably inserted in a first slide hole 60 defined in a second sleeve 58 disposed on the first sleeve 34 and a second slide hole 64 defined in a die sleeve 62 (support die) disposed on the second sleeve 58. The knockout pins 54 are disposed in surrounding relation to the spline punch 50.

Stated otherwise, the spline punch 50 extends through the first slide hole 60 and the second slide hole 64 in a state of being surrounded by the knockout pins 54. The spline punch 50 has a lower end portion supported on the second support plate 52 and is securely positioned in the first slide hole 60 and the second slide hole 64.

The spline punch 50 has a plurality of spline forming teeth 66 for forming the splines 18 (see FIG. 1) on the circumferential side wall surface of an upper end portion thereof, the spline forming teeth 66 protruding radially outwardly. When the knockout pins 54 are in the lowermost position thereof, upper end faces of the knockout pins 54 are positioned below the spline forming teeth 66.

The die sleeve 62 has an annular ridge 68 projecting vertically upwardly from an upper end face thereof. The annular ridge 68 supports the flange 16 of the workpiece 24 from below.

The large-diameter portion 36 of the first sleeve 34 supports thereon an annular plate 70 that is fitted over the tubular portion 42. The tubular portion 42 is surrounded by a pedestal 72 fitted thereover. On the pedestal 72, there are successively disposed a positioning member 74 that surrounds a portion of the second sleeve 58 and positions the second sleeve 58 and a surrounding member 76 that surrounds the remaining portion of the second sleeve 58 and a portion of the die sleeve 62. The positioning member 74 and the surrounding member 76 are successively arranged in the order named from below. A plurality of positioning pins 78 (first engaging members) are mounted on and extend upwardly from the surrounding member 76.

The upper die 28 has a dog tooth machining punch (external tooth machining die) including dog tooth machining teeth 80 for finishing the dog teeth 20, a guide sleeve 86 supported by the dog tooth machining punch 82 and having a guide hole 84 defined therein, and a support sleeve 88 supporting the dog tooth machining punch 82 and the guide sleeve 86.

The dog tooth machining punch 82 has a plurality of positioning holes 90 defined therein. The positioning holes 90 function as second engaging members with which the positioning pins 78 engage.

The support sleeve 88 has a large-diameter holding hole 92 defined therein. The holding hole 92 communicates with the guide hole 84. A pressing sleeve 94 (pressing die) that is relatively displaceable with respect to the lower die 26, i.e., that can be lifted and lowered, is housed in the guide hole 84 and the holding hole 92.

The pressing sleeve 94 serves to press the flange 16 of the workpiece 24 for thereby lowering the workpiece relatively along the spline punch 50. The pressing sleeve 94 has a housing hole 96 defined therein by an inner circumferential wall surface thereof for allowing the upper end portion of the spline punch 50 to enter the housing hole 96. The pressing sleeve 94 is floatingly supported, for example, by a helical spring, a gas spring, or the like, not shown.

When a lifting and lowering mechanism, not shown, combined with the support sleeve 88 is actuated, the upper die 28 can be displaced toward or away from the lower die 26, i.e., can be lifted or lowered. When the upper die 28 is lowered, the die assembly is closed, and when the upper die 28 is lifted, the die assembly is opened.

The forging apparatus 22 according to the present embodiment is basically constructed as described above. Operation and advantages of the forging apparatus 22 will be described below in reference to the method of manufacturing the gear 10 according to the present embodiment.

Figure 3:
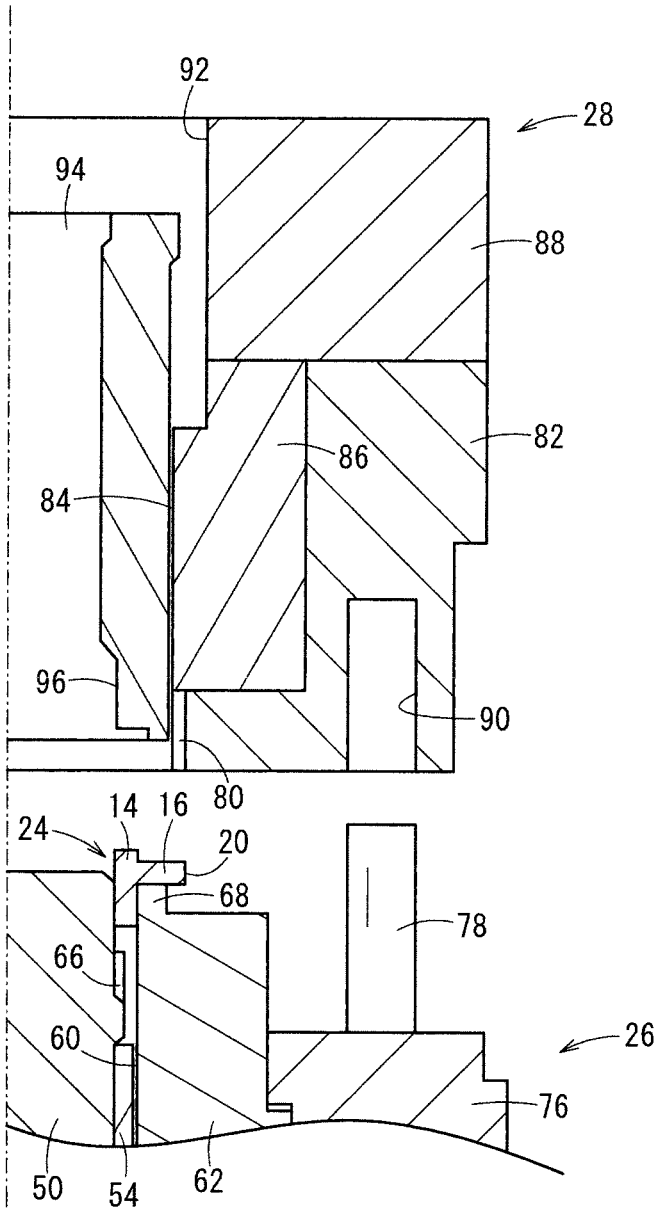
FIG. 3 is an enlarged view of main portion of the forging apparatus shown in FIG. 2.

The workpiece 24, i.e., the preformed product, shown in FIG. 2 is produced when a blank is forged by another forging apparatus to form the dog teeth 20 on the outer circumferential wall surface of the flange 16. For fabricating the gear 10, as shown at an enlarged scale in FIG. 3, the spline punch 50 is inserted into the through hole 12 in the workpiece 24. At this stage, the workpiece 24 is positioned above the spline forming teeth 66 of the spline punch 50, and the hollow cylinder 14 is inserted between the spline punch 50 and the die sleeve 62.

Figure 4:
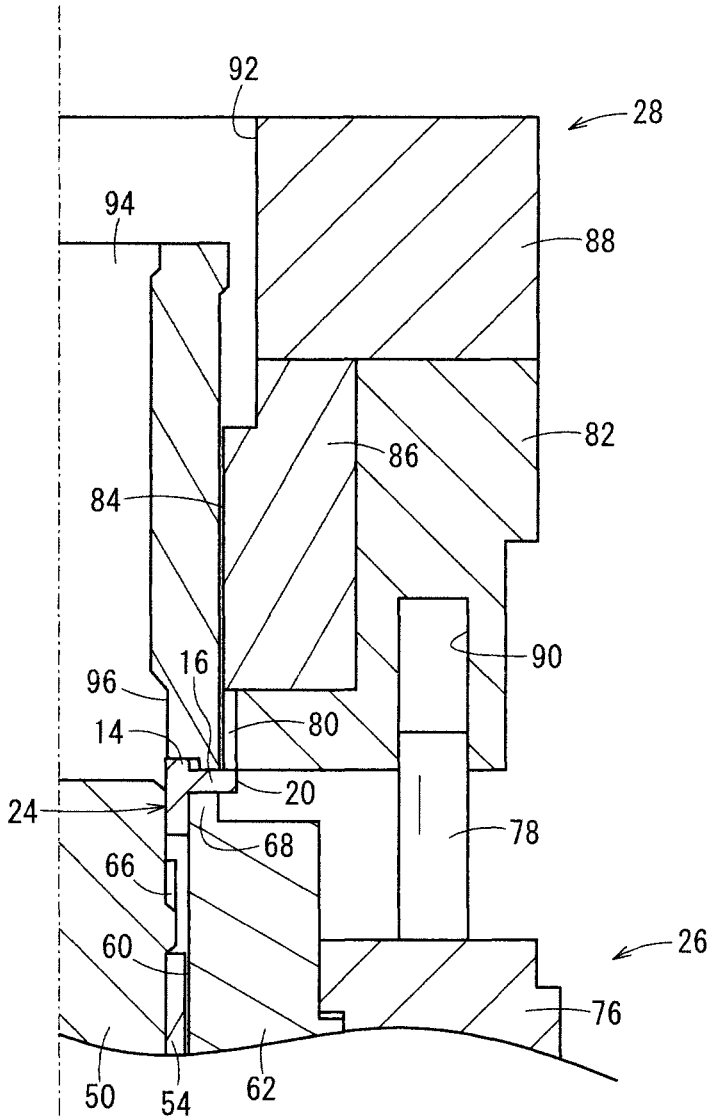
FIG. 4 is an enlarged view showing the manner in which an upper die is lowered from the position shown in FIG. 2 to bring a pressing die (pressing sleeve) into abutment against a workpiece.

Then, the lifting and lowering mechanism is actuated to lower the upper die 28 toward the lower die 26. Upon descent of the upper die 28, the pressing sleeve 94 abuts against the workpiece 24 as shown in FIG. 4. The workpiece 24 is pressed, and the pressing force (load) applied thereto is transmitted through the die sleeve 62, the second sleeve 58, and the first sleeve 34 to the damping rods 32 of the gas springs 30. The dog tooth machining teeth 80 of the dog tooth machining punch 82 are caused to abut against the dog teeth 20, and the positioning pins 78 start moving into the respective positioning holes 90.

Figure 5:
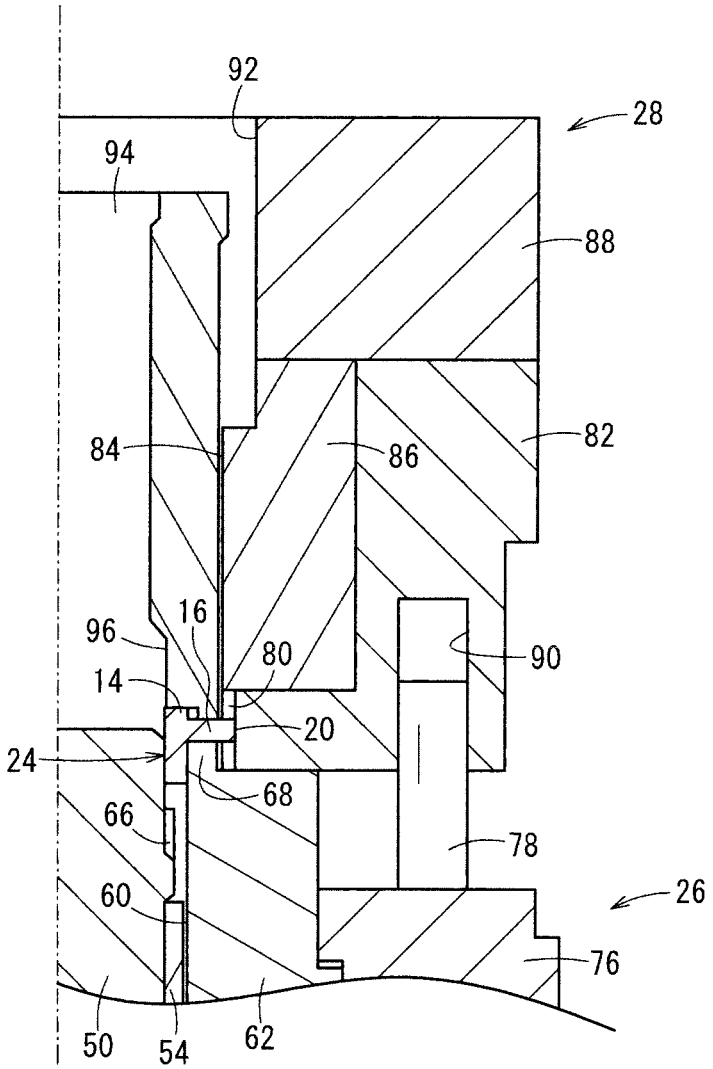
FIG. 5 is an enlarged view showing the manner in which an external tooth machining die (dog tooth forming die) is lowered from the position shown in FIG. 4 into abutment against a support die (die sleeve) while the pressing die (pressing sleeve) is being held in position.

As the lifting and lowering mechanism applies a force to the upper die 28 to further lower the upper die 28, the helical spring, the gas spring, or like that supports the pressing sleeve 94 is compressed or retracted. Therefore, the pressing sleeve 94 is kept in a position held against the workpiece 24. At the same time, as shown in FIG. 5, the dog tooth machining punch 82, the guide sleeve 86, and the support sleeve 88 are lowered. In other words, the pressing sleeve 94 is relatively elevated within the guide hole 84 and the holding hole 92.

When the dog tooth machining punch 82 is lowered as described above, it finishes the dog teeth 20. While the dog tooth machining punch 82 is being lowered, it is guided by the positioning pins 78.

During the above stage, the load acting on the gas springs 30 is smaller than the preset load referred to above. Therefore, the damping rods 32 of the gas springs 30 are not retracted (lowered). The first sleeve 34, the second sleeve 58, and the die sleeve 62 are not lowered, and hence the workpiece 24 remains unchanged in position.

When the dog tooth machining punch 82 abuts against the upper end face of the die sleeve 62, the finishing process performed on the dog teeth 20 by the dog tooth machining punch 82 comes to an end. As described above, according to the present embodiment, the dog tooth machining punch 82 is lowered while preventing the die sleeve 62, which serves as the support die, from being lowered, thereby machining the external teeth into a final gear form.

The lifting and lowering mechanism continuously applies the force tending to lower the upper die 28. Therefore, the pressing force is applied from the dog tooth machining punch 82 to the die sleeve 62. The applied pressing force, i.e., the load acting on the gas springs 30, exceeds the preset load.

Figure 6:
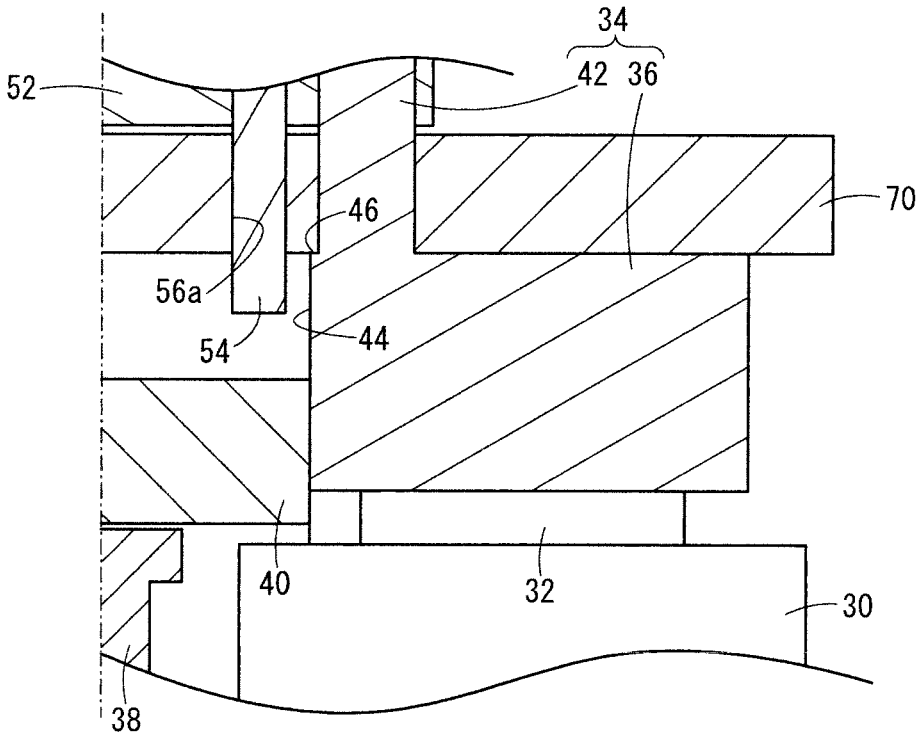
FIG. 6 is an enlarged view showing the manner in which the rod of a gas spring as a damping mechanism is lowered.

After the finishing process performed on the dog teeth 20 comes to an end and the dog tooth machining punch 82 abuts against the upper end face of the die sleeve 62, the dog tooth machining punch 82 is continuously lowered, so that a load in excess of the preset load is applied to the damping rods 32 of the gas springs 30. As a result, as shown in FIG. 6, the damping rods 32 are lowered (retracted).

As the damping rods 32 of the gas springs 30 are lowered, the first sleeve 34, the second sleeve 58, and the die sleeve 62 are lowered. Since some of the components that make up the lower die 26 are lowered, the upper die 28 can be lowered further.

Figure 7:
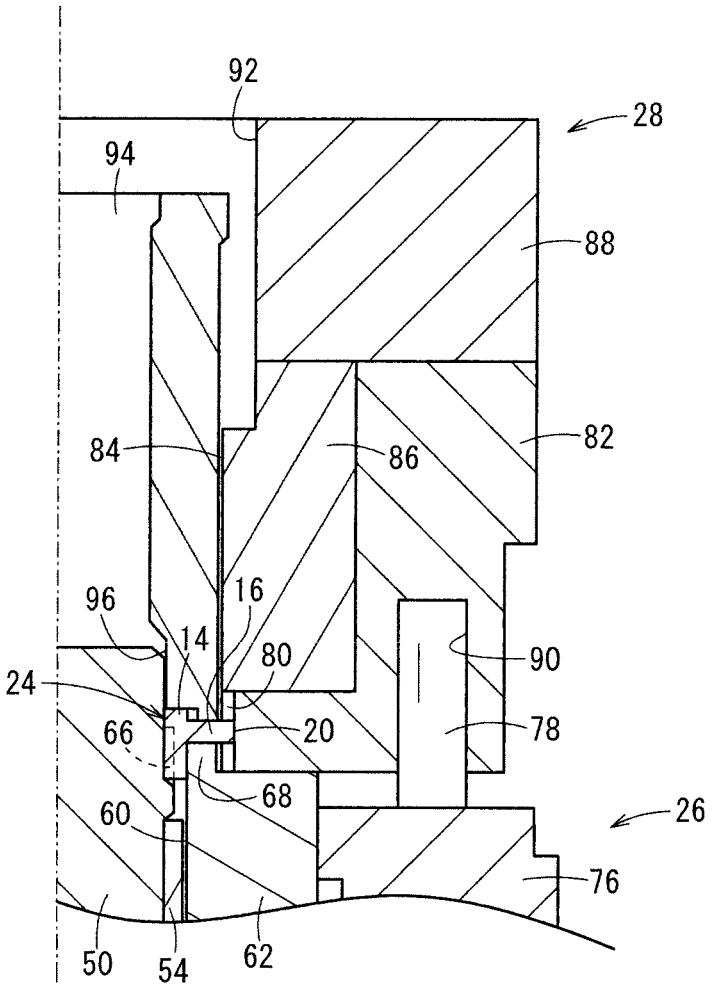
FIG. 7 is an enlarged view showing the manner in which a workpiece is lowered with further lowering of the upper die and splines are formed on an inner circumferential wall surface of the workpiece.

Specifically, as shown in FIG. 7, the dog tooth machining punch 82, the guide sleeve 86, the support sleeve 88, and the pressing sleeve 94 are lowered. Upon descent of the pressing sleeve 94, the workpiece 24 is pressed by the pressing sleeve 94. As a consequence, the workpiece 24 is lowered along the spline punch 50. The upper end portion of the spline punch 50 enters the housing hole 96 that is defined in the pressing sleeve 94. During this time, inasmuch as the positioning pins 78 are inserted in the respective positioning holes 90 defined in the dog tooth machining punch 82, the dog tooth machining punch 82 is prevented from being rotated about its own axis, i.e., from being brought out of phase.

As described above, the spline punch 50 has the spline forming teeth 66 on the circumferential side wall surface thereof. Thus, the workpiece 24 descends and moves along the spline forming teeth 66, whereby splines 18 are formed on the inner circumferential wall surface of the workpiece 24. The workpiece 24 is thus machined into the gear 10.

According to the present embodiment, during one-time closing of the die assembly of the forging apparatus 22, the forging apparatus 22 finishes the dog teeth 20 of the workpiece 24 and forms the splines 18 on the workpiece 24. Owing thereto, the cycle time of the forging apparatus 22 can be shortened, and thus the cost of the gear 10 can be reduced.

Figure 8:
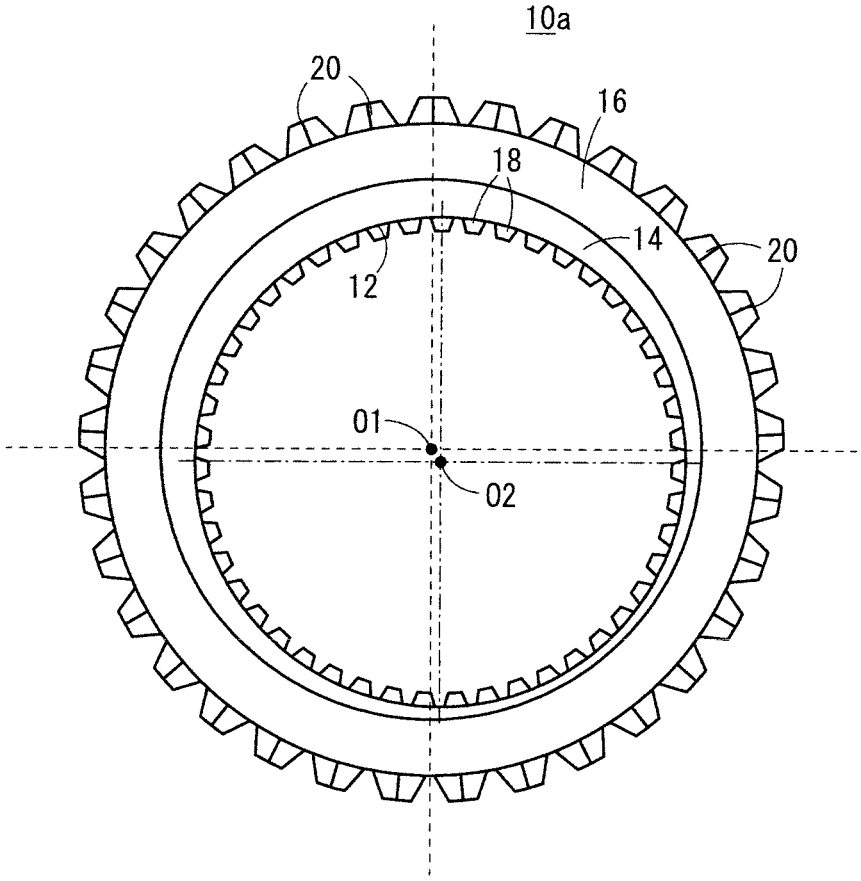
FIG. 8 is an overall schematic plan view of a gear which is of poor coaxiality.

FIG. 8 shows a gear 10*a* that is manufactured by simultaneously finishing the dog teeth 20 as external teeth and forming the splines 18 as internal teeth. In FIG. 8, the point O1 of intersection between broken lines represents the center of a circle along the dog teeth 20, whereas the point O2 of intersection between dot-and-dash lines represents the center of a circle along the splines 18. In this case, since it is not easy to control the flow of the material of the workpiece to be machined into the gear 10*a*, the points O1, O2 tend to be shifted out of positional alignment. In other words, the gear 10*a* is of poor coaxiality, and it is difficult to achieve a high yield of such gears.

By contrast, according to the present embodiment, as described above, finishing of the dog teeth 20, i.e., external teeth, and forming of the splines 18, i.e., internal teeth, are performed at different times. Consequently, it is easy to control the flow of the material of the workpiece 24. In addition, according to the present embodiment, the dog tooth machining punch 82 is prevented from being brought out of phase. For these reasons, the coaxiality between the dog teeth 20 and the splines 18 can be enhanced.

When the splines 18 are formed, the dog tooth machining teeth 80 are maintained in the position for finishing the dog teeth 20. In other words, the workpiece 24 is restrained in position by the dog tooth machining teeth 80. Therefore, the forming accuracy is enhanced.

According to the present embodiment, the forging apparatus 22 is capable of successively manufacturing gears that are of excellent dimensional accuracy within a short period of time. The forging apparatus 22 is thus suitable for use as a mass-production facility.

Further, the forging apparatus 22 employs the gas springs 30 as damping mechanisms. Therefore, the forging apparatus 22 does not need to perform a process for supplying and discharging a working oil, as disclosed in Japanese Patent No. 3769856, and accordingly does not require a mechanism for such a process. The forging apparatus 22 can thus be of a small-scale, simple structure, and hence can be effective to reduce investments for facilities required to manufacture the gear 10.

After the gear 10 is manufactured, the lifting and lowering mechanism is actuated to lift the upper die 28, thereby opening the die assembly. At this time, the pressing sleeve 94 is released from the bias by the helical spring, the gas spring, or like, and returns to its initial position.

Thereafter, the extrusion cylinder is operated to push forward (lift) the extrusion rod 38. Accordingly, the extrusion plate 40 is lifted into the insertion hole 44 defined in the first sleeve 34. The extrusion plate 40 then presses the knockout pins 54 upwardly from below. The knockout pins 54 are elevated to lift the gear 10 along the spline punch 50. The gear 10 is finally pushed up to the upper end portion of the spline punch 50 for easy removal from the spline punch 50.

The present invention is not limited to the above embodiment, but various changes and modifications may be made thereto without departing from the scope of the invention.

For example, the damping mechanisms may comprise helical springs. In this case, the load under which the helical springs start being compressed, i.e., the load under which the workpiece 24 starts being lowered, is established based on spring constants or the like. When the workpiece 24 pressed by the pressing sleeve 94 is lowered, the helical springs (damping mechanism) are lowered as a whole.

The damping mechanisms may comprise a back-pressure regulating device which employs a working oil.

The external teeth of the gear 10 are not limited to the dog teeth 20, and the internal teeth thereof are not limited to the splines 18. Stated otherwise, forming teeth of appropriate shapes may be used instead of the spline forming teeth 66 and the dog tooth machining teeth 80 to form other teeth than the dog teeth 20 or the splines 18.

In the present embodiment, a finishing process is performed on the dog teeth 20. However, machining processes other than the finishing process, such as a process of forming external teeth and a process of deburring the dog teeth 20, may be performed.

The surrounding member 76 may have the positioning holes 90, and the dog tooth machining punch 82 may have the positioning pins 78.

What is claimed is:

1. A method of manufacturing a gear having external teeth on an outer circumferential wall surface thereof and internal teeth on an inner circumferential wall surface thereof, comprising the steps of:

bringing a pressing die and an external tooth machining die toward a workpiece having a through hole, with an internal tooth forming die being inserted in the through hole, the workpiece being supported from below by a support die, and causing the pressing die to abut against the workpiece;

forming the external teeth on the outer circumferential wall surface of the workpiece by lowering the external tooth machining die while preventing the support die from being lowered under action of damping mechanisms that support the support die from below; and after the external tooth machining die abuts against the support die, pressing the support die to cause some or all of the damping mechanisms to descend, and pressing the workpiece with the external teeth formed thereon by the pressing die to lower the workpiece along the internal tooth forming die for thereby forming the internal teeth on the inner circumferential wall surface of the workpiece.

2. The method according to claim 1, wherein the support die is surrounded by a surrounding member having first engaging members, and the external tooth machining die has second engaging members, the method further comprising the step of:

causing the first engaging members and the second engaging members to engage with each other when the external tooth machining die is lowered.

3. The method according to claim 1, wherein the damping mechanisms comprise gas springs having respective rods, the method further comprising the step of:

lowering the rods when the external tooth machining die presses the support die.

4. The method according to claim 1, wherein the step of forming the external teeth comprises finishing the external teeth.

* * * * *